US006557638B2

(12) United States Patent
Cunningham et al.

(10) Patent No.: US 6,557,638 B2
(45) Date of Patent: May 6, 2003

(54) CONCENTRIC TUBING COMPLETION SYSTEM

(75) Inventors: Christopher E. Cunningham, Spring, TX (US); Christopher D. Bartlett, Spring, TX (US); Marcus A. Smedley, Mesquite, TX (US); Russell E. McBeth, The Woodlands, TX (US); Robert B. Baten, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/954,458

(22) Filed: Sep. 14, 2001

(65) Prior Publication Data

US 2002/0074124 A1 Jun. 20, 2002

Related U.S. Application Data

(60) Provisional application No. 60/232,527, filed on Sep. 14, 2000.

(51) Int. Cl.[7] ..... E21B 29/12

(52) U.S. Cl. ..... 166/348; 166/344; 166/345

(58) Field of Search ..... 166/345, 348, 166/344, 368

(56) References Cited

U.S. PATENT DOCUMENTS

| | | | | | |
|---|---|---|---|---|---|
| 3,421,580 | A | * | 1/1969 | Fowler et al. | 166/336 |
| 3,459,259 | A | * | 8/1969 | Matthews | 166/358 |
| 3,693,714 | A | | 9/1972 | Baugh | |
| 3,770,053 | A | * | 11/1973 | Martin et al. | 166/365 |
| 4,053,023 | A | * | 10/1977 | Herd et al. | 175/7 |
| 4,067,062 | A | | 1/1978 | Baugh | |
| 4,139,058 | A | * | 2/1979 | Gano | 166/360 |
| 4,613,162 | A | * | 9/1986 | Hughes | 285/27 |
| 4,880,061 | A | | 11/1989 | Ahlstone | |
| 4,903,774 | A | | 2/1990 | Dykes et al. | |
| 5,113,939 | A | | 5/1992 | Ross et al. | |
| 5,655,603 | A | | 8/1997 | Schulte et al. | |
| 5,819,852 | A | * | 10/1998 | Cunningham et al. | 166/345 |
| 5,941,310 | A | * | 8/1999 | Cunningham et al. | 166/345 |
| 6,109,352 | A | * | 8/2000 | Edwards et al. | 166/336 |
| 6,237,689 | B1 | * | 5/2001 | Wardlaw | 166/337 |
| 6,293,345 | B1 | * | 9/2001 | Watkins | 166/368 |

FOREIGN PATENT DOCUMENTS

GB 2 254 634 A 10/1992

* cited by examiner

*Primary Examiner*—Robert E. Pezzuto
*Assistant Examiner*—Thomas A. Beach
(74) *Attorney, Agent, or Firm*—Henry C. Query, Jr.

(57) ABSTRACT

The concentric tubing completion system of the present invention comprises a surface Christmas tree which is located on a surface structure, a tieback connector which is secured to a mudline wellhead that is installed at the upper end of a subsea well bore, a mudline tubing hanger which is supported in the tieback connector, and a pair of concentric tubing strings which are suspended from corresponding tubing hangers in the surface Christmas tree and connected to the mudline tubing hanger. The annulus between the concentric tubing strings communicates with a number of passages in the mudline tubing hanger which are connected to the tubing annulus below the mudline tubing hanger. Thus, lift gas or other fluids may be communicated between the surface christmas tree and the tubing annulus through this annulus between the concentric tubing strings.

20 Claims, 13 Drawing Sheets

CONCENTRIC TUBING COMPLETION SYSTEM

This application claims the benefit of provisional application Ser. No. 60/232,527, filed Sep. 14, 2000.

BACKGROUND OF THE INVENTION

The present invention relates to gas lift completion systems for subsea oil wells and, more specifically, to a concentric tubing completion system in which the annulus around the production tubing string within the production riser is used to supply lift gas to the well.

In many subsea oil wells, the pressure within the well is not sufficient to force the oil out of the formation and up the production riser to the Christmas tree which is mounted on a structure such as a vessel or a platform that is located at the surface of the ocean. In such situations, a gas lift method is commonly employed to help the oil reach the tree. In order to utilize this method, high pressure gas must be conveyed from the surface structure to the annulus between the production tubing and the well casing. Currently, the gas for gas lift applications is typically supplied to the subsea well by a second tubing string which extends parallel to the production tubing string within the production riser. However, this type of system requires the use of a dual bore Christmas tree, a dual string tubing hanger and special tubing handling equipment, which results in increased complexity and cost for the completion system.

SUMMARY OF THE INVENTION

The present invention addresses these limitations in the prior art by providing a concentric tubing completion system for communicating a fluid between a surface structure and a mudline wellhead which is installed at the upper end of a subsea well bore. The completion system comprises a surface christmas tree which is located on the surface structure, a tieback connector which is connected to the mudline wellhead, and a mudline tubing hanger which is supported in the tieback connector and from which is suspended a tubing string that extends into the well bore and defines a tubing annulus surrounding the tubing string. The concentric tubing completion system also comprises an outer tubing hanger which is supported by the surface Christmas tree, an inner tubing hanger which is supported by the surface Christmas tree, an outer tubing string which is connected between the outer tubing hanger and the mudline tubing hanger, and an inner tubing string which is disposed within the outer tubing string and which is connected between the inner tubing hanger and the mudline tubing hanger.

In accordance with the present invention, the inner and outer tubing strings define an annulus between them which communicates with a number of annulus passageways that extend through the mudline tubing hanger to the tubing annulus. Therefore, the fluid may be communicated between the surface christmas tree and the tubing annulus through the annulus between the inner and outer tubing strings. In gas lift applications, this eliminates the need for an independent, parallel tubing string within the production riser for communicating gas from the surface christmas tree to the tubing annulus. Consequently, a dual bore christmas tree, a dual string tubing hanger and special tubing handling equipment are not required with the concentric tubing completion system of the present invention.

The concentric tubing completion system may also include one or more devices for adjusting the tension in the inner and outer tubing strings. For example, the outer tubing string may be connected to the outer tubing hanger with a ratch-latch mechanism. Similarly, the inner tubing string may be connected to the inner tubing hanger with a ratch-latch mechanism. In this manner, the tension in both the inner and outer tubing strings may be independently adjusted at the surface structure.

These and other objects and advantages of the present invention will be made apparent from the following detailed description, with reference to the accompanying drawings. In the drawings, the same reference numbers are sometines used to denote similar components in the various embodiments.

DETAILED DESCRIPTION OF THE PREFERRED EMBODIMENTS

The present invention provides a simple and inexpensive system of components for communicating lift gas or other fluids between a christmas tree which is located on a surface structure, such as a tension leg platform or a floating vessel, and a tubing annulus which extends into a subsea well. The tubing annulus may be any of the annuli formed between the successive strings of concentric tubing which extend into the well bore; but for purposes of simplicity the invention will be described in the context of the production tubing annulus, which is the annular volume between the production tubing and the production casing.

Generally, the concentric tubing completion system of the present invention comprises a surface christmas tree which is located on a surface structure, a tieback connector which is secured to a mudline wellhead that is installed at the upper end of a subsea well bore, a mudline tubing hanger which is supported in the tieback connector, and a pair of concentric tubing strings which are suspended from corresponding tubing hangers in the surface christmas tree and connected to the mudline tubing hanger. The annulus between the concentric tubing strings communicates with a number of passages in the mudline tubing hanger which are connected to the production tubing annulus below the mudline tubing hanger. Thus, lift gas or other fluids may be communicated between the surface christmas tree and the production tubing annulus through this annulus between the concentric tubing strings. The completion system of the invention preferably also includes a riser pipe which is connected between the tieback connector and the surface christmas tree and within which the concentric tubing strings are positioned to, among other things, absorb the environmental forces which otherwise would be transmitted to these tubing strings.

Figure 1:
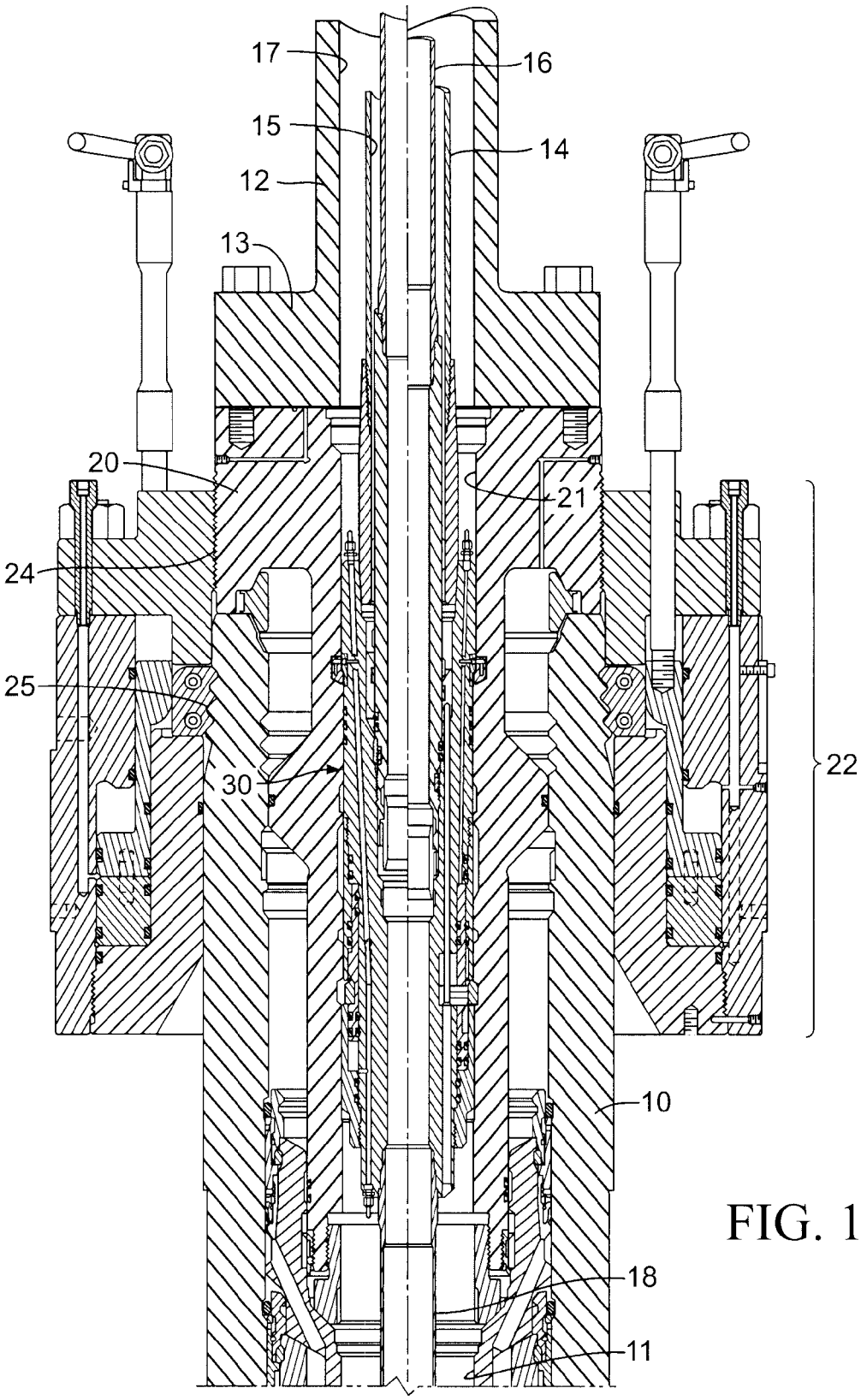
FIG. 1 is a cross-sectional view of the mudline wellhead, tieback connector and mudline tubing hanger components of one embodiment of the present invention.

Referring to FIG. 1, mudline wellhead 10 is installed at the upper end of a subsea well bore (not shown), and a tieback connector 20 is attached to the mudline wellhead with a locking assembly 22. The locking assembly 22 is threaded to the tieback connector 20 generally at 24 and locks the tieback connector to the mudline wellhead 10 by engaging a number of grooves 25 that are formed on the outer diameter of the mudline wellhead. The tieback connector 20 includes a central bore 21 in which a mudline tubing hanger 30 is suspended. The mudline tubing hanger 30 is connected to the top of a production tubing string 18 which extends into the well bore (not shown) and defines a production tubing annulus 11 surrounding the tubing string. The lower end of a riser pipe 12 terminates in a flange 13 which is bolted to the top of the tieback connector 20. As will be described below, the upper end of the riser pipe is connected to a surface christmas tree. In addition, an outer tubing string 14 and an inner tubing string 16 extend within the riser pipe 12 between the mudline tubing hanger 30 and the surface christmas tree and define an annulus 15 through which lift gas or other fluid may be communicated.

Figure 2A:
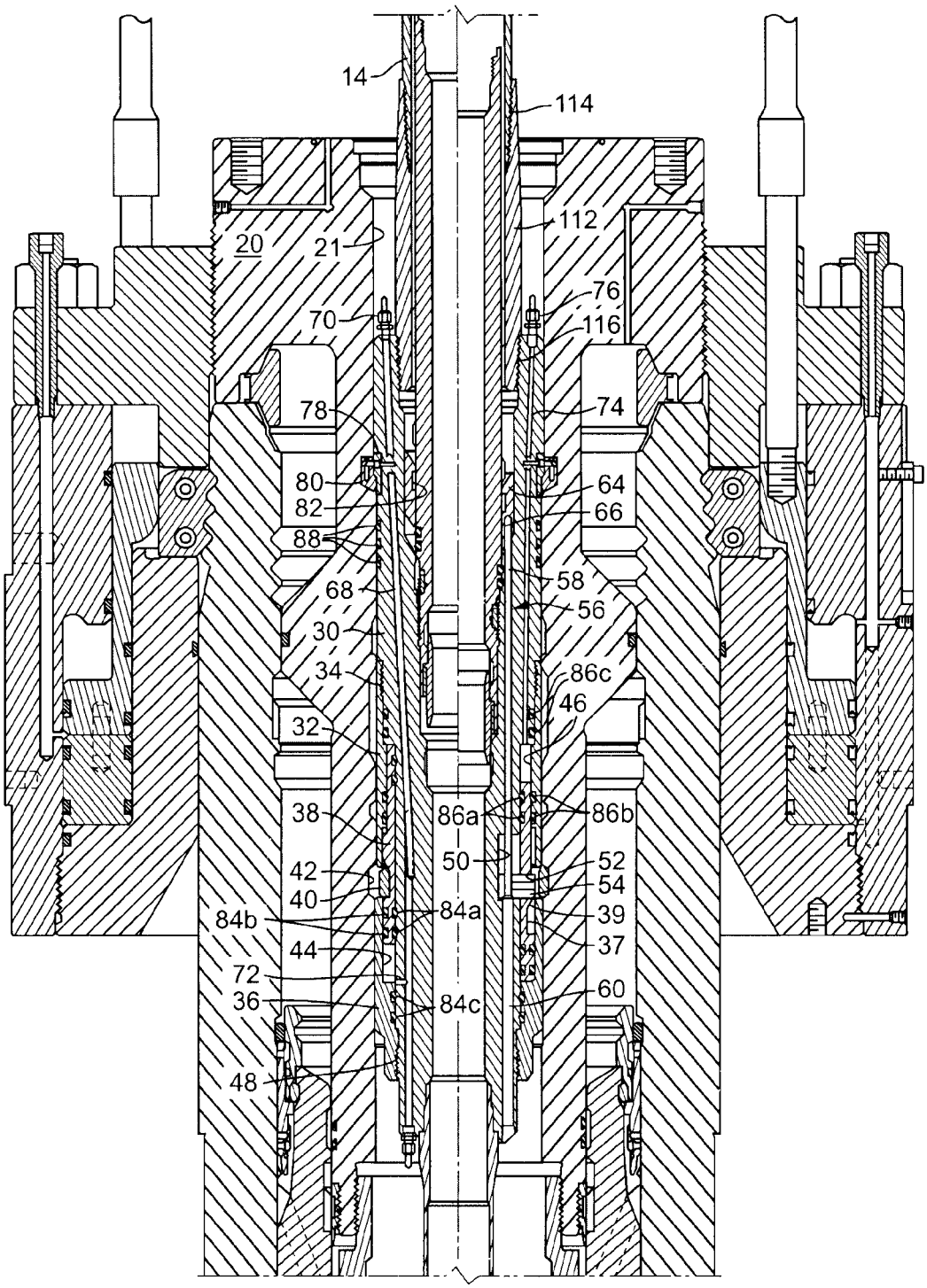
FIG. 2*a* is an enlarged cross-sectional view of the components depicted in FIG. 1.

The mudline tubing hanger 30 is run into the tieback connector 20 on the outer tubing string 14. Referring to FIG. 2*a*, the lower end of the outer tubing string 14 is threaded to an outer adapter 112 generally at 114. The outer adapter 112 is in turn threaded to the top of the mudline tubing hanger 30 generally at 116. A high-strength insert 78 having an external shoulder formed thereon is attached to the outer diameter of the mudline tubing hanger 30, and this external shoulder lands on an internal shoulder which is formed on a second insert 80 that is recessed in the central bore 21 of the tieback connector 20. A number of seals 88 are disposed between the outer diameter of the mudline tubing hanger 30 and the bore 21 to isolate the production tubing annulus 11 from a riser annulus 17 which is formed between the riser pipe 12 and the outer tubing string 14.

The mudline tubing hanger 30 is preferably locked to the tieback connector 20 using a hydraulic locking mechanism that will now be described. An upper sleeve 32 is threaded to the outer diameter of the mudline tubing hanger 30 generally at 34. Similarly, a lower sleeve 36 is threaded to the outer diameter of the mudline tubing hanger 30 generally at 48. The outer diameter of the mudline tubing hanger 30, the upper sleeve 32 and the lower sleeve 36 cooperate to form an annular cavity in which a piston 38 is slidably disposed. The piston 38 includes an external groove 37 which is bounded on its upper end by a cam surface 39. The upper end of the piston 38 cooperates with the mudline tubing hanger 30 and the upper sleeve 32 to create an upper hydraulic chamber 46 which is fluidly isolated from the rest of the system by a number of seals 86*a*, 86*b*, and 86*c*. Similarly, the lower end of the piston 38 cooperates with the mudline tubing hanger 30 and the lower sleeve 36 to create a lower hydraulic chamber 44 which is isolated from the rest of the system by a number of seals 84*a*, 84*b*, and 84*c*. The upper hydraulic chamber 46 is fluidly connected to a hydraulic coupler 76 via a flow passageway 74. Similarly, the lower hydraulic chamber 44 is fluidly connected to a hydraulic coupler 70 vial flow passageways 68 and 72. The hydraulic couplers 70 and 76 are connected to corresponding hydraulic valves at the surface structure via control lines (not shown) which are ideally run through the riser annulus 17.

The axial gap between the upper sleeve 32 and the lower sleeve 36 coincides with a groove 42 which is formed in the central bore 21 of the tieback connector 20. Prior to running the mudline tubing hanger 30 into the tieback connector 20, the lower hydraulic chamber 44 is energized, which forces the piston 38 up into the retracted position shown to the left of the centerline in FIG. 2*a*. In this position, the external groove 37 on the piston 38 coincides with the groove 42 in the central bore 21 of the tieback connector 20. In addition, an inwardly biased locking ring 40 rests partially in the groove 37 and partially in the axial gap between the upper and lower sleeves 32, 36, thus clearing the groove 42. When the mudline tubing hanger 30 is landed in the tieback connector 20, the upper hydraulic chamber 46 is energized, which forces the piston 38 down into the locked position shown to the right of the centerline in FIG. 2*a*. As the piston moves to this position, the cam surface 39 forces the locking ring 40 out into the groove 42, thus locking the mudline tubing hanger 30 to the tieback connector 20.

The tubing hanger locking mechanism just described is equipped with a mechanical override device which may be used in the event of a hydraulic failure or fouling of the mechanism by debris. A number of vertical grooves 50 are formed in the outer diameter of the mudline tubing hanger 30, and the piston 38 includes a corresponding number of transverse apertures 52 which are located generally opposite the grooves 50. The radially inner portion of an insert 54 is received in each groove 50, and the radially outer portion of the insert is positioned in the corresponding aperture 52. In addition, a plurality of lifting rods 56 are slidably disposed in corresponding holes in the mudline tubing hanger 30 and the inserts 54. Each of the rods 56 includes an upper portion 58 and a larger diameter lower portion 60 which is disposed below inserts 54. The upper ends of rods 56 are threaded into a lifting ring 64 generally at 66. When an override of the locking mechanism is required, a tool is run down to the mudline wellhead 10, engaged in a groove 82 in the lifting ring 64, and pulled upwards. As the rods 56 are lifted, the larger diameter portions 60 will engage the inserts 54 and lift both the inserts and the piston 38 into the retracted position.

Figure 2B:
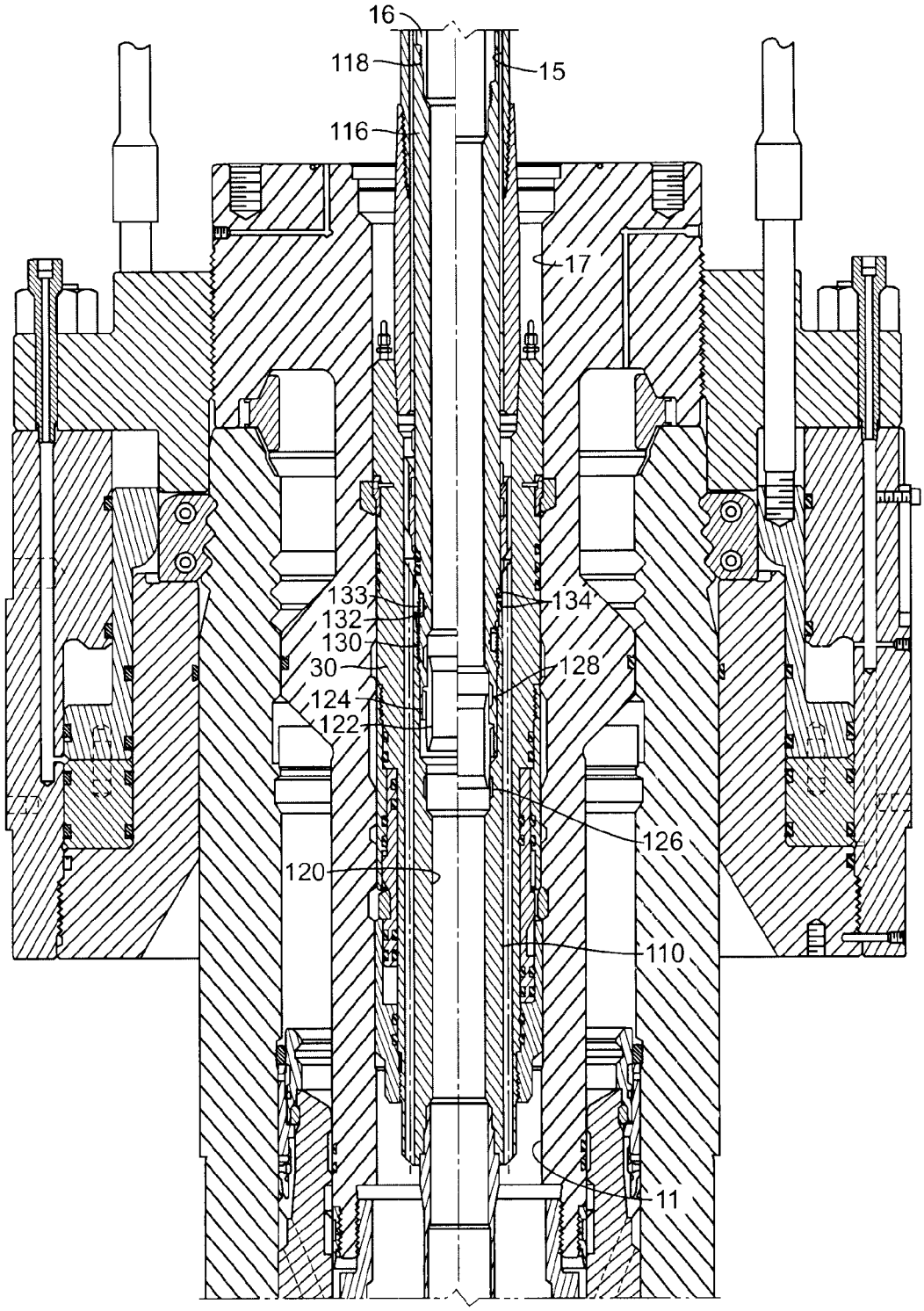
FIG. 2*b* is an enlarged cross-sectional view of the components of FIG. 1, showing a cross section of the components at a different angle than the cross section of FIG. 2*a;*

Once the mudline tubing hanger 30 is landed and locked to the tieback connector 20, the inner tubing string 16 is run through the outer tubing string 14 and landed in the mudline tubing hanger. Referring to FIG. 2*b*, the lower end of the inner tubing string 16 is threaded to the upper end of an inner adapter 116 generally at 118. An annular metal-to-metal seal 122 is threaded to the lower end of the inner adapter 116 generally at 124. The seal 122 seals to the inner diameter of the adapter 116 generally at 128 and, when the adapter 116 is landed in the mudline tubing hanger 30, to the bore 120 of the mudline tubing hanger 30 generally at 126.

The inner adapter 116 is connected to the mudline tubing hanger 30 by a ratch-latch type locking mechanism which will now be described. The locking mechanism includes a latch ring 132 which is positioned in a corresponding groove that is formed on the outer diameter of the adapter 116. The latch ring 132 is spring biased radially outward and includes one or more upwardly and outwardly facing teeth 133. These teeth are adapted to engage a plurality of inwardly and downwardly facing teeth 130 which are formed on the inner diameter of the mudline tubing hanger 30. The engagement of the teeth 130 with the teeth 133 will firmly secure the inner adapter 116 to the mudline tubing hanger 30. A number of conventional seals 134 are provided to seal between the outer diameter of the adapter 116 and the bore 120 of the mudline tubing hanger 30 once the adapter is fully landed in the mudline tubing hanger.

It may therefore be seen that the inner and outer tubing strings 16, 14 form an annulus 15 through which gas, well fluids and the like may be communicated. Furthermore, the mudline tubing hanger 30 includes one or more axially extending flow passages 110 which communicate between the production tubing annulus 11 and a portion of the mudline tubing hanger which is located between the inner and outer adapters 116, 112. Consequently, the annulus 15 between the inner and outer tubing strings 16, 14 is connected to the production tubing annulus 11 through the flow passages 110 in the mudline tubing hanger 30.

Figure 3:
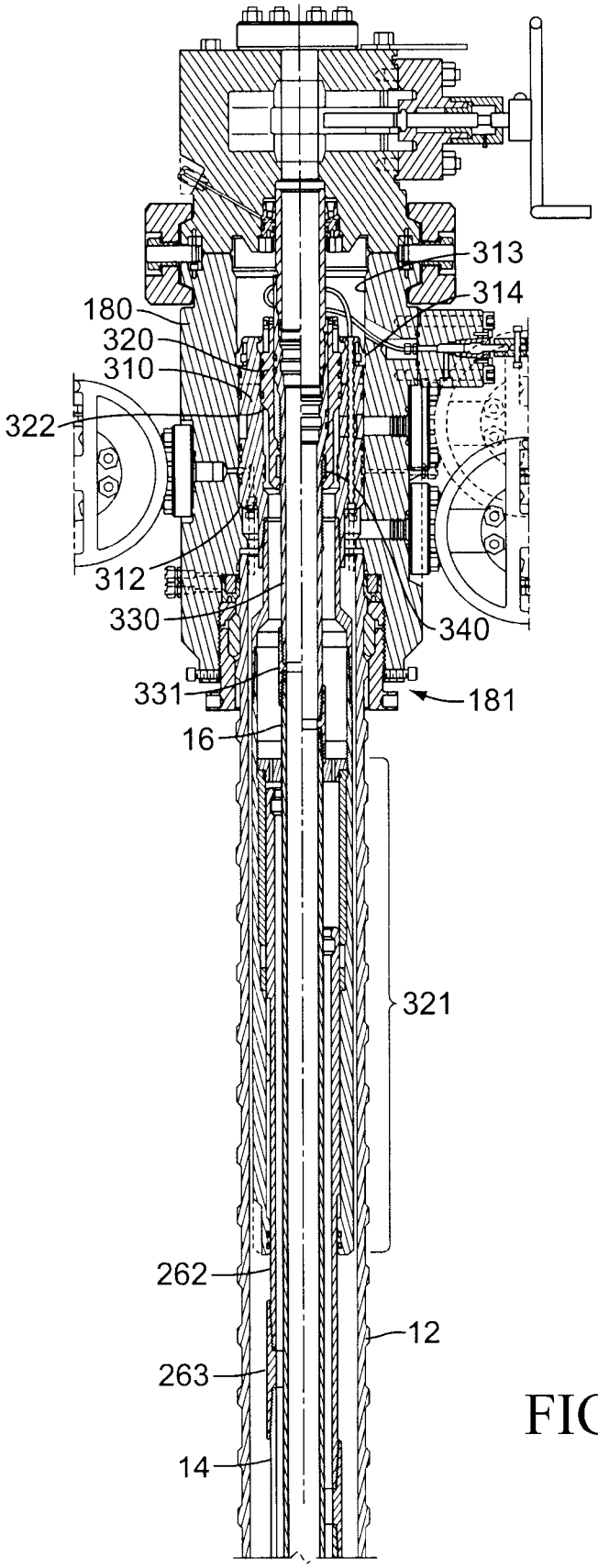
FIG. 3 is a cross-sectional view of the surface christmas tree, inner tubing hanger, outer tubing hanger, inner tubing string and outer tubing string components of one embodiment of the present invention.

Referring to FIG. 3, the upper ends of the riser pipe 12, the inner tubing string 16 and the outer tubing string 14 are terminated at a surface christmas tree 180. The upper end of the riser pipe 12 is locked to the lower end of the surface christmas tree 180 using a conventional connector assembly 181. The upper end of inner tubing string 16 is connected to an inner adapter 330 via an inner bushing 331. The inner adapter 330 is connected to an inner tubing hanger 320 via a ratch-latch mechanism 340, which will be described hereafter. The inner tubing hanger 320 is in turn landed on an internal shoulder 322 which is formed on the inner diameter of an outer tubing hanger 310 that is supported in the surface christmas tree 180. The upper end of the outer tubing string 14 is attached to an outer adapter 262 via an outer bushing 263. The outer adapter 262 is connected to the lower end of the outer tubing hanger 310 via a tension adjustment mechanism 321, which will be described more fully below. The outer tubing hanger 310 is in turn supported on an internal shoulder 312 which is formed in a central bore 313 that extends axially through the surface christmas tree 180. In addition, the outer tubing hanger 312 is preferably locked to the surface christmas tree 180 by conventional means, such as locking dogs 314.

Figure 4A:
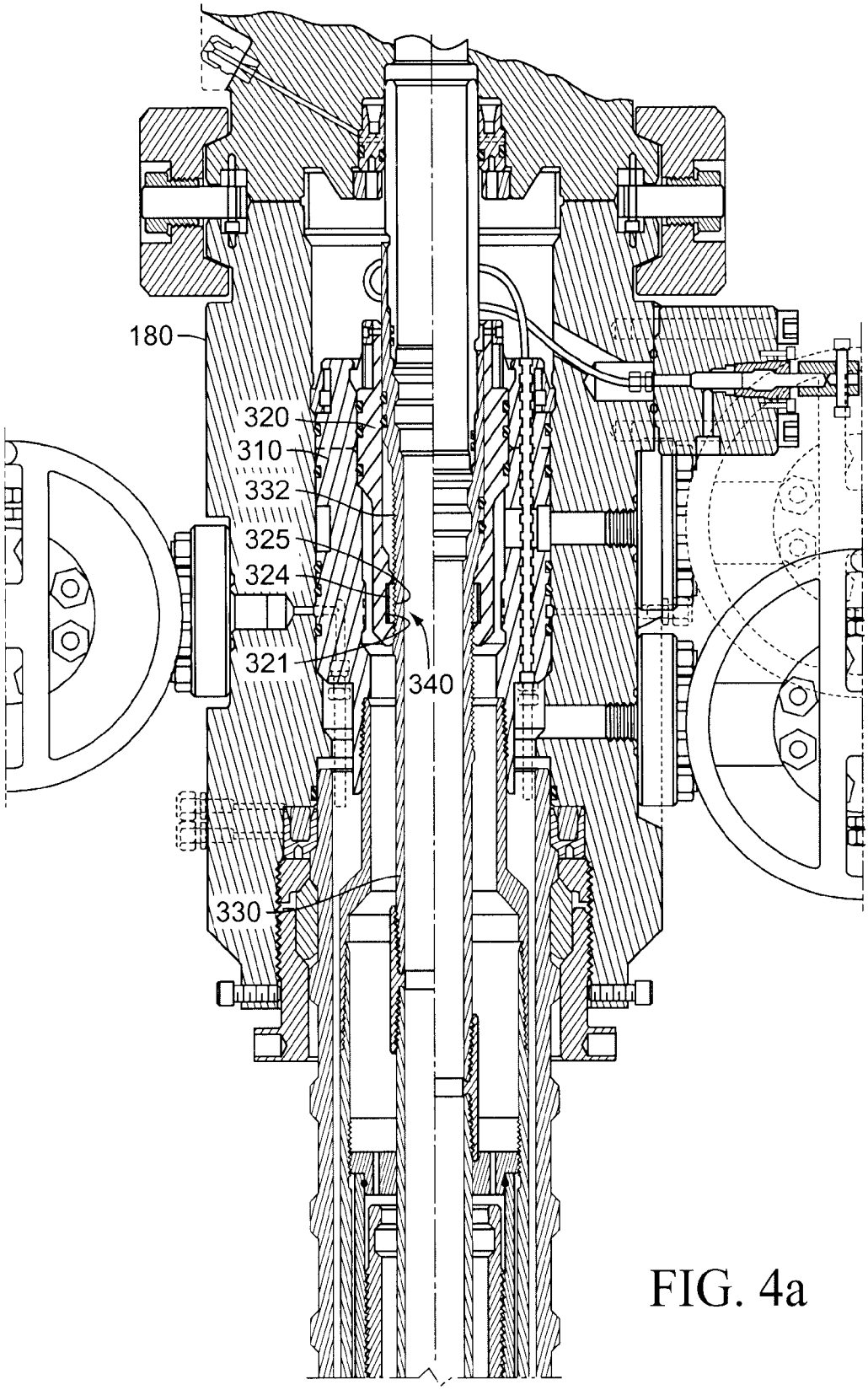
FIG. 4*a* is an enlarged cross-sectional view of the surface christmas tree, inner tubing hanger and outer tubing hanger components depicted in FIG. 3.

Referring to FIG. 4*a*, the ratch-latch mechanism 340 comprises an inwardly biased lock ring 324 which is retained in a groove 321 that is formed on the inner diameter of the inner tubing hanger 320. The lock ring 324 includes a set of inwardly and upwardly facing teeth 325. A substantial axially extending portion of the outer diameter of the inner adapter 330 is provided with a set of outwardly and downwardly facing teeth 332, which are adapted to engage the teeth 325 on the lock ring 324. The axial span of the teeth 332 provides a wide range of locking positions for the adapter 330. Thus, the tension in the inner tubing string 16 can be adjusting by changing the axial position of the inner adapter 330 relative to the inner tubing hanger 320.

Figure 4B:
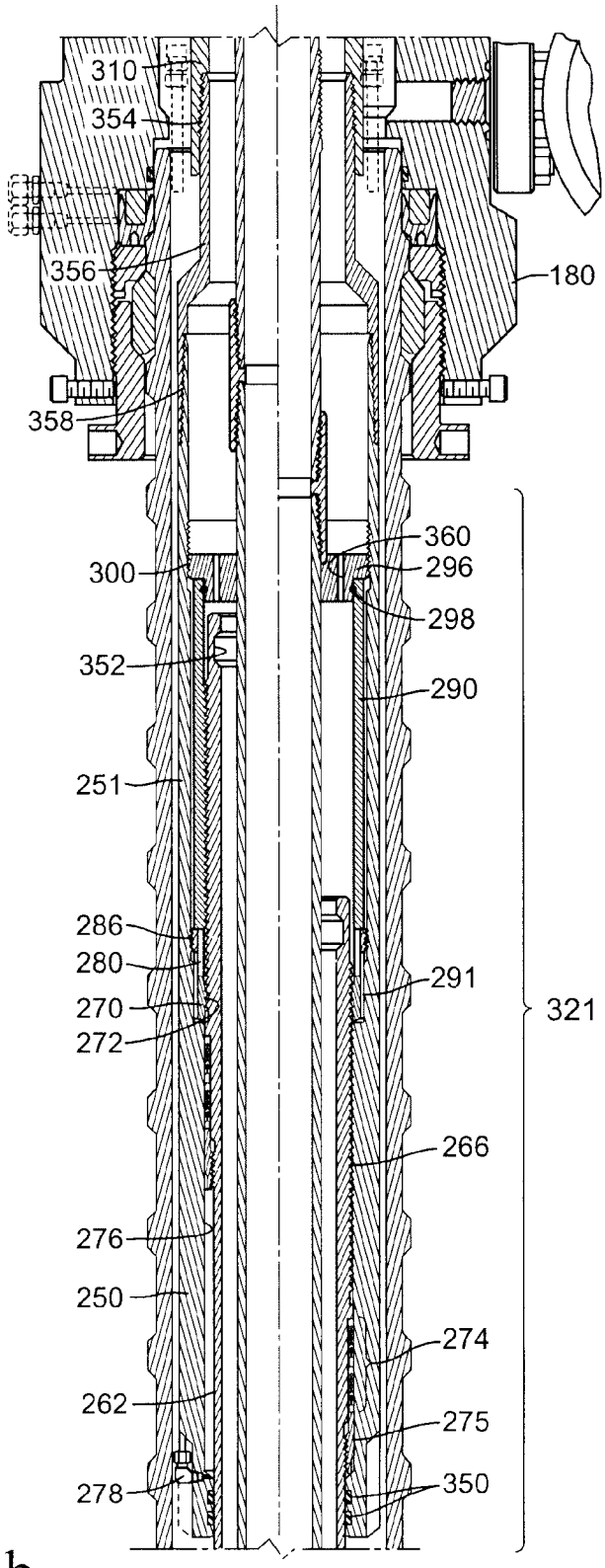
FIG. 4*b* is an enlarged cross-sectional view of the inner tubing string and outer tubing string components depicted in FIG. 3.

Referring to FIG. 4*b*, the tension adjustment mechanism 321 includes a sleeve 250 within which the outer adapter 262 is slidably disposed. A number of seals 350 are positioned at the lower end of the sleeve 250 to seal between the sleeve and the outer adapter 262. The upper end of the sleeve 250 is threaded to an expander bushing 356 generally at 358. The expander bushing 356 is in turn threaded to the bottom of the outer tubing hanger 310 generally at 354. A locking mandrel 290 is positioned between the outer adapter 262 and an upper section 251 of the sleeve 250. The upper end of the locking mandrel 290 is attached to a drive collar 296 such as by a snap ring 298, and the drive collar is in turn threaded to the sleeve 250 generally at 300. An inwardly biased lock ring 270 is positioned below the locking mandrel 290. The lock ring 270 includes a number of upwardly and inwardly facing teeth 272 that are adapted to engage corresponding outwardly and downwardly facing teeth 266 which are formed on the outer diameter of the outer adapter 262. A retaining ring 280 is positioned above the lock ring 270 and is threaded to the sleeve 250 by interrupted threads to hold the lock ring in place. The locking mandrel 290 includes a plurality of thin fingers 291 which can fit through the interruptions in the threads 286 and behind the lock ring 270 when the drive collar 296 is screwed down. The lower section of the sleeve 250 cooperates with the outer adapter 262 to form a hydraulic chamber 276 which is supplied by a port 278 and an associated hydraulic line (not shown), and which is isolated by a number of seals 350 and a packing 274 that is secured in place by a gland nut 275.

In operation, when the outer tubing string 14 is landed in the mudline tubing hanger 30, a tool engages a groove 352 in the adapter 262 and pulls upward to tension the string. When the proper tension is reached, the hydraulic chamber 276 is energized to drive the sleeve 250, the bushing 356, and the outer tubing hanger 310 downward until the outer tubing hanger is landed and locked in the surface christmas tree 180. A second tool is then used to engage a number of slots 360 in the drive collar 296 to rotate the drive collar and thereby drive the locking mandrel 290 downward. Once the fingers 291 have been inserted behind the lock ring 270, the outer tubing string 14 properly tensioned and locked in position. The inner tubing string 16 can then be run, landed, tensioned and locked as described above.

Figure 5:
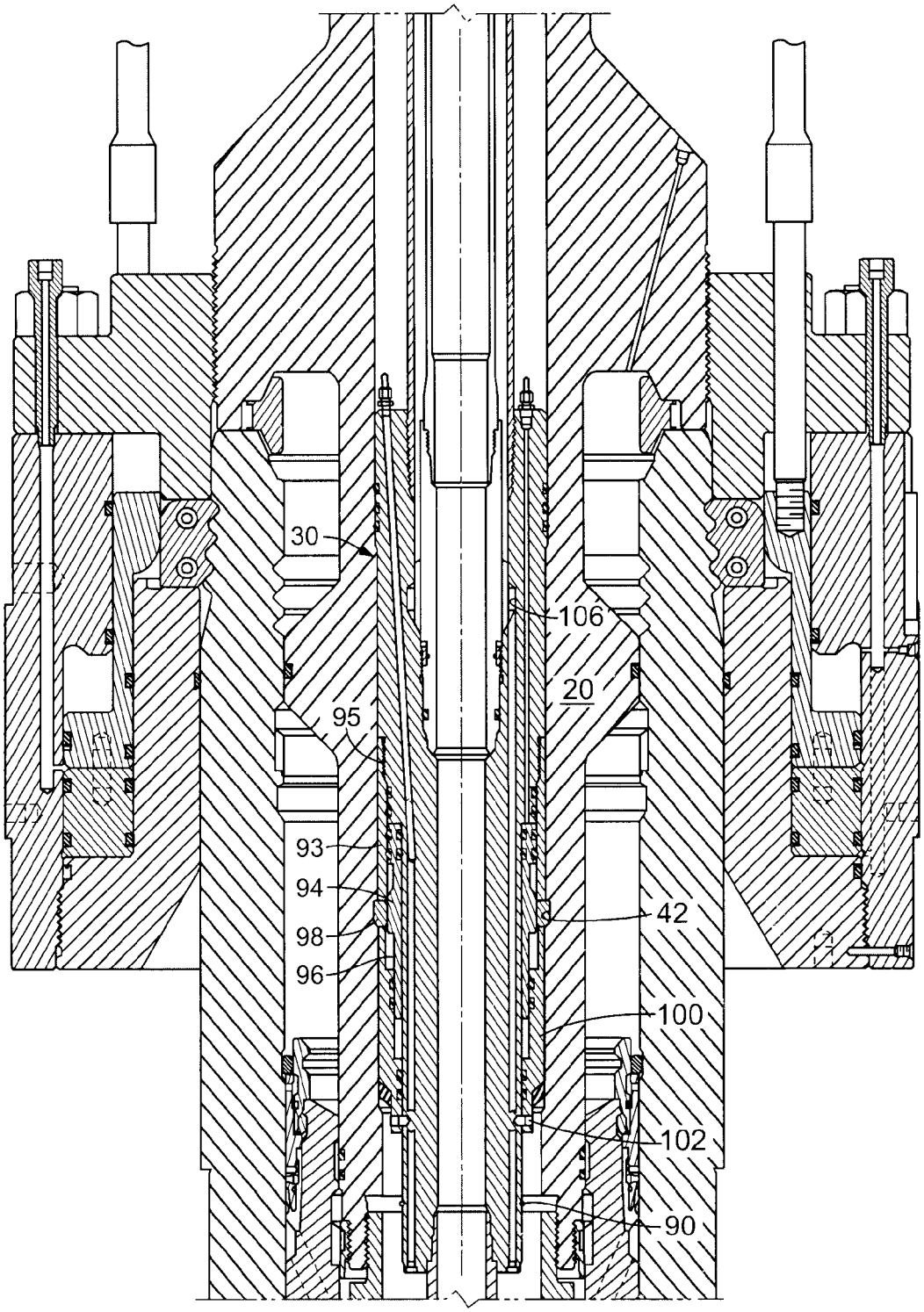
FIG. 5 is a cross-sectional view of an alternative embodiment of the mudline tubing hanger component of the present invention.

Referring to FIG. 5, an alternative embodiment of the mudline tubing hanger 30 is shown landed in the tieback connector 20. An upper sleeve 93 is threaded to the outer diameter of the mudline tubing hanger 30 generally at 95. In addition, a lower sleeve 100 is attached to the outer diameter of the mudline tubing hanger 30 by a plurality of shear pins 102. The mudline tubing hanger 30, the upper sleeve 93 and the lower sleeve 100 cooperate to form an annular cavity in which a piston 94 is slidably disposed. The piston 94 is actuated in a manner similar to the piston 38 in the embodiment shown in FIG. 2*a*. However, in the present embodiment the retracted position of the piston 94 is down. Thus, when the piston 94 is in the upper, or locked, position, an inwardly biased locking ring 98 similar to the locking ring 40 is forced outward into a groove 42 in the central bore of the tieback connector 20 to lock the mudline tubing hanger 30 to the tieback connector.

In the event of a hydraulic failure or fouling of the locking mechanism, the mudline tubing hanger 30 can be retrieved by engaging a groove 106 on the inner diameter of the mudline tubing hanger with a running tool and applying an upward force large enough shear the shear pins 102. Once the shear pins 102 have been sheared, the lower sleeve 100 will drop down onto a lower catch ring 90, which will prevent the sleeve 100 from dropping into the well bore. As the mudline tubing hanger 30, the upper sleeve 93 and the piston 94 are lifted up, the locking ring 98 will snap onto a smaller diameter portion 96 of the piston. In this position, the locking ring 98 will clear the groove 42, and the mudline tubing hanger 30 can be brought to the surface.

Figure 6A:
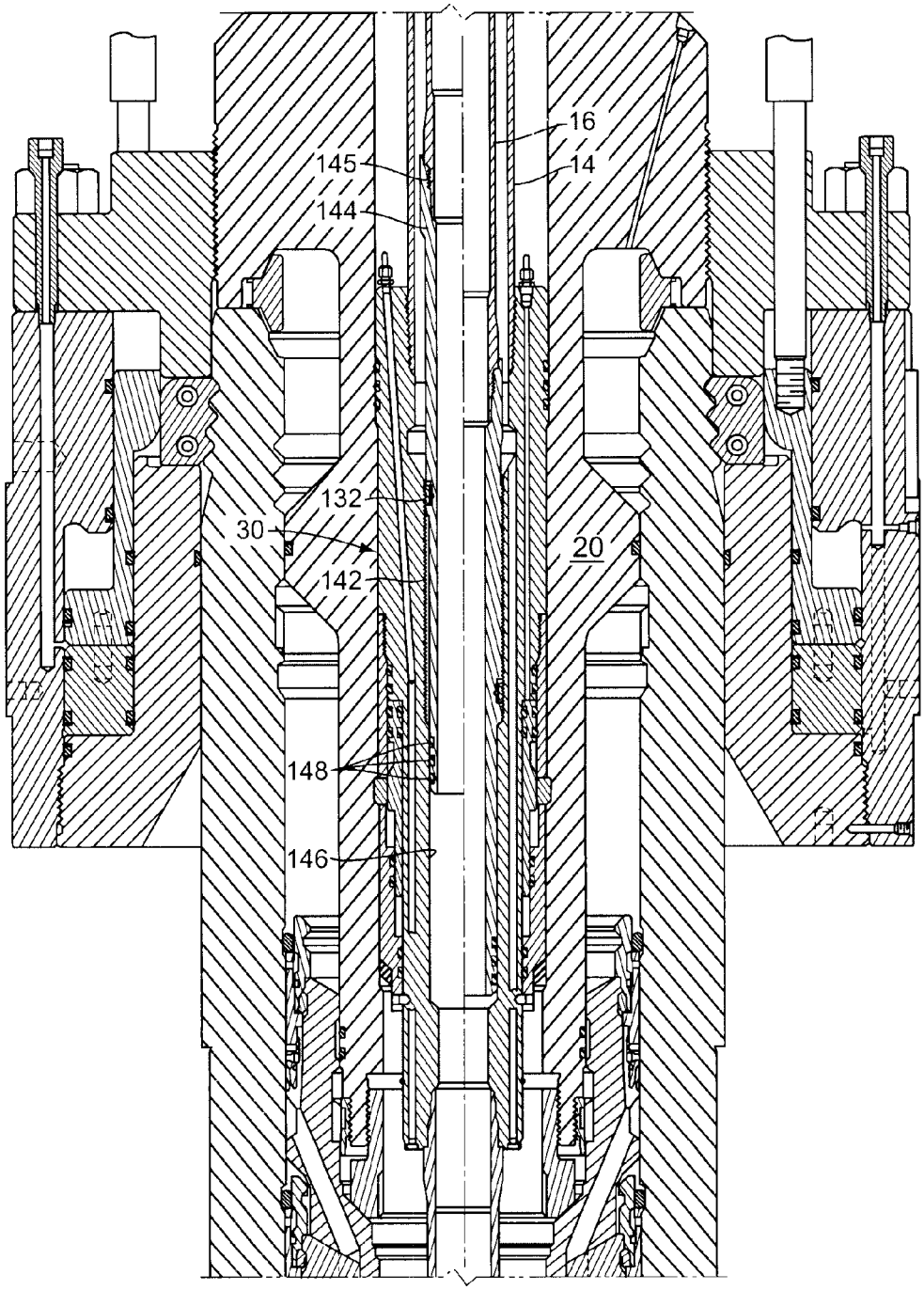
FIGS. 6*a* and 6*b* are cross-sectional views of the mudline tubing hanger showing two alternative embodiments of the mechanism which is used to connect the inner tubing string to the mudline tubing hanger.
Figure 6B:
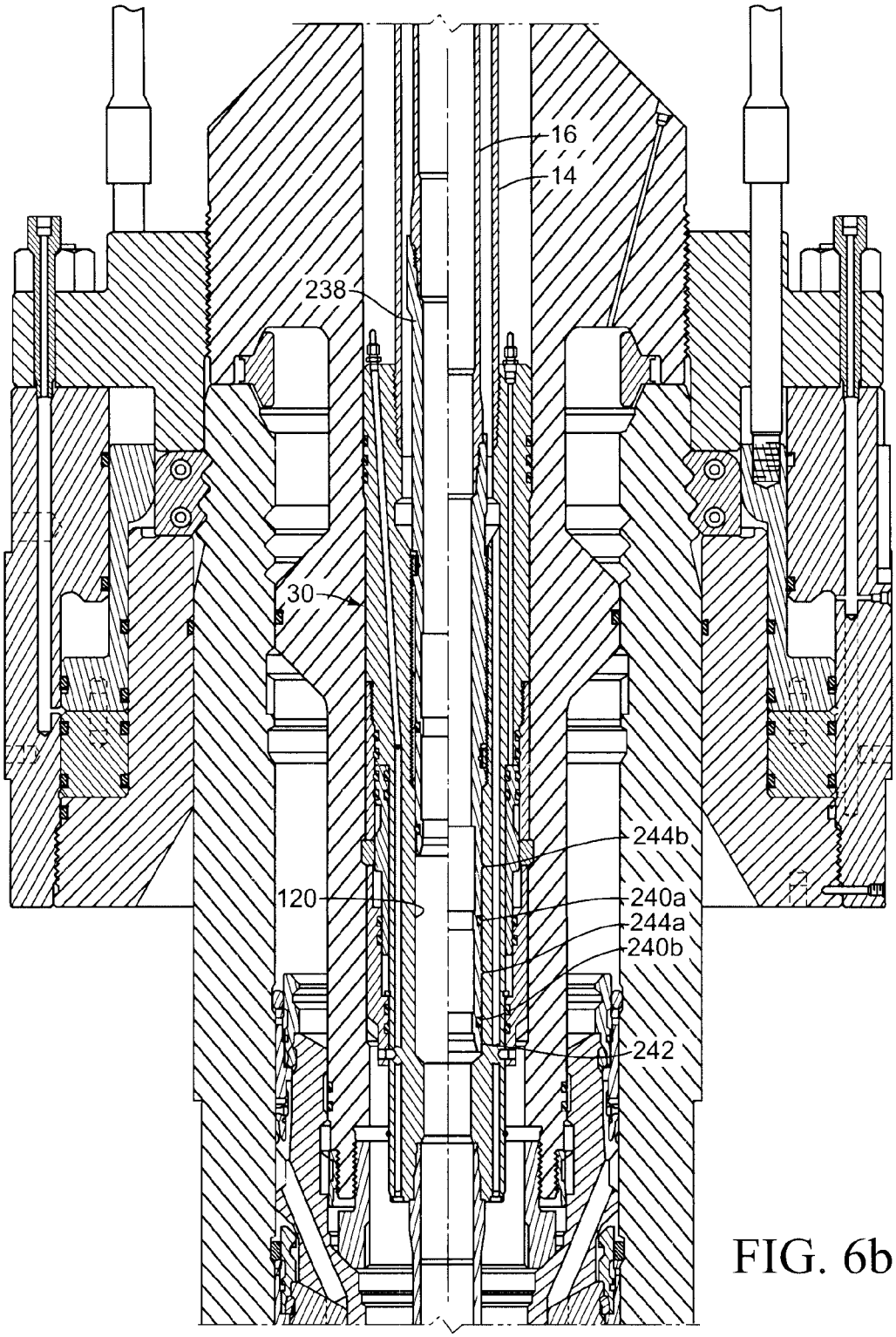

FIGS. 6*a* and 6*b* illustrate alternative embodiments of the mechanism used to connect the inner tubing string 16 to the mudline tubing hanger 30. The mechanisms of each of these embodiments allow the tension in the inner tubing string 16 to be adjusted at the mudline tubing hanger 30.

In the embodiment shown in FIG. 6*a*, the lower end of the inner tubing string 16 is threaded to an inner adapter 144 generally a 145. The inner adapter 144 is locked to the inner diameter of the mudline tubing hanger 30 by a ratch-latch mechanism similar to the one described above in connection with FIG. 2*b*. However, the section of inwardly and downwardly facing teeth 142 on the inner diameter of the mudline tubing hanger 30 is greatly elongated in the present embodiment. In other words, the axial extent of the teeth 142 is substantially greater than the axial height of the latch ring 132. Furthermore, the latch ring 132 which is carried on the inner adapter 144 can latch at any axial position along the teeth 142. This allows the tension in the inner tubing string 16 to be readily adjusted by changing the latching position. Once the inner adapter 144 is latched to the mudline tubing hanger 30, a number of preferably elastomeric seals 148 will seal between the inner adapter and the inner diameter of the mudline tubing hanger.

In the embodiment of the concentric tubing completion system shown in FIG. 6*b*, the inner tubing string is connected to an inner adapter 238 which is secured to the mudline tubing hanger 30 in a manner similar to that shown in FIG. 6*a*. However, in this embodiment a different sealing arrangement is provided between the inner adapter 238 and the mudline tubing hanger 30. This sealing arrangement includes an annular lip seal 242 which is optimally formed on the extreme lower end of the outer diameter of the inner adapter 238. In addition, an upper preferably elastomeric seal 240*a* is disposed between the inner adapter 238 and the mudline tubing hanger 30 above the lip seal 242, and a lower preferably elastomeric seal 240*b* is disposed between the inner adapter and the mudline tubing hanger below the upper elastomeric seal 240*a*. Furthermore, a first sealing ridge 244*a* is formed on the outer diameter of the inner adapter 238 between the elastomeric seals 240*a* and 240*b*, and a second sealing ridge 244*b* is formed on the outer diameter of the inner adapter above the upper elastomeric seal 240*a*. When the inner adapter 238 is landed in the mudline tubing hanger 30, the lip seal 242 and the sealing ridges 244*a* and 244*b* will form metal-to-metal seals with the inner diameter of the mudline tubing hanger to ensure that a pressure tight seal is created between these components.

Figure 7A:
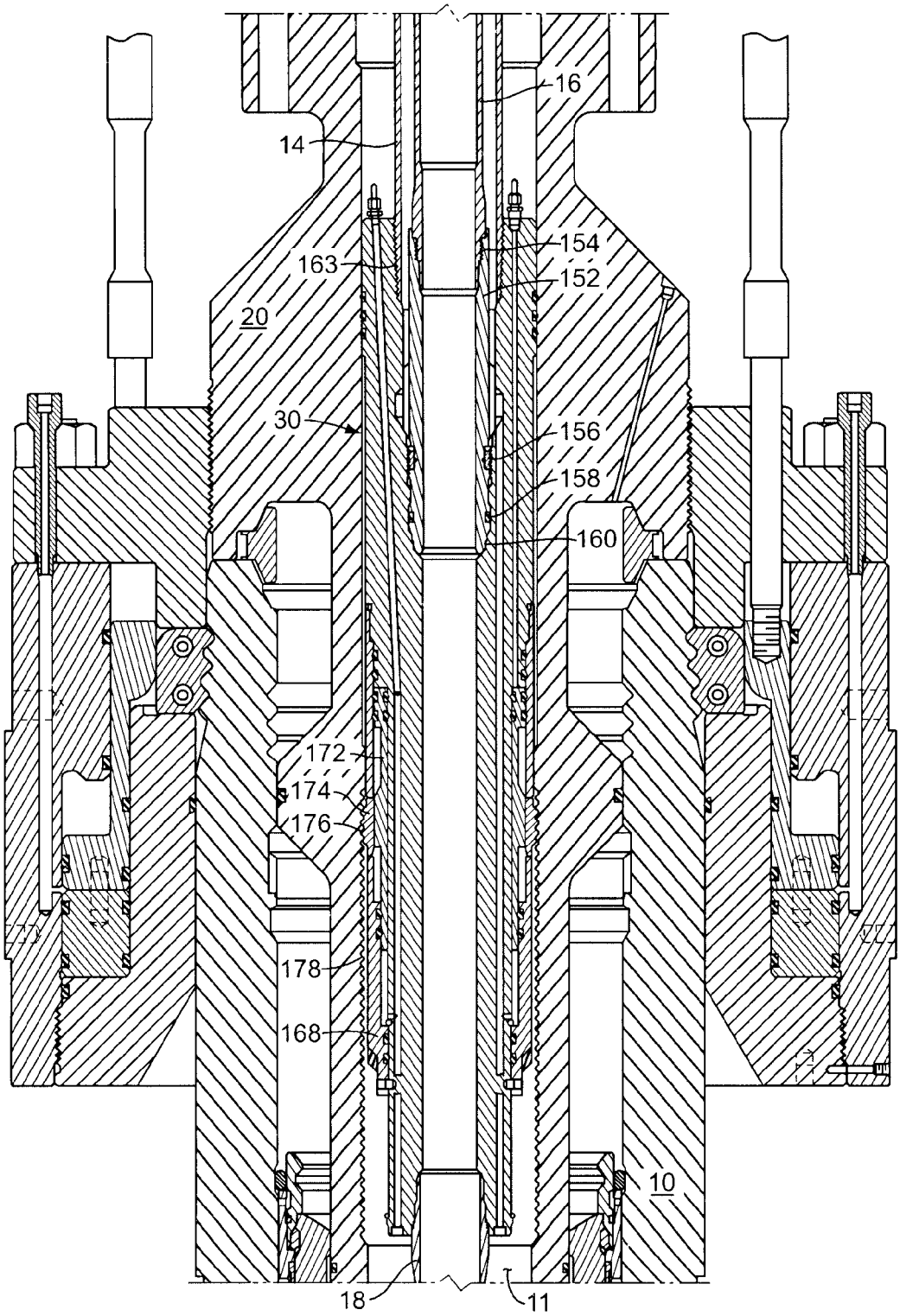
FIGS. 7*a* and 7*b* are cross-sectional views showing the components of an alternative embodiment of the invention connected to the mudline wellhead component and to the surface christmas tree component, respectively.
Figure 7B:
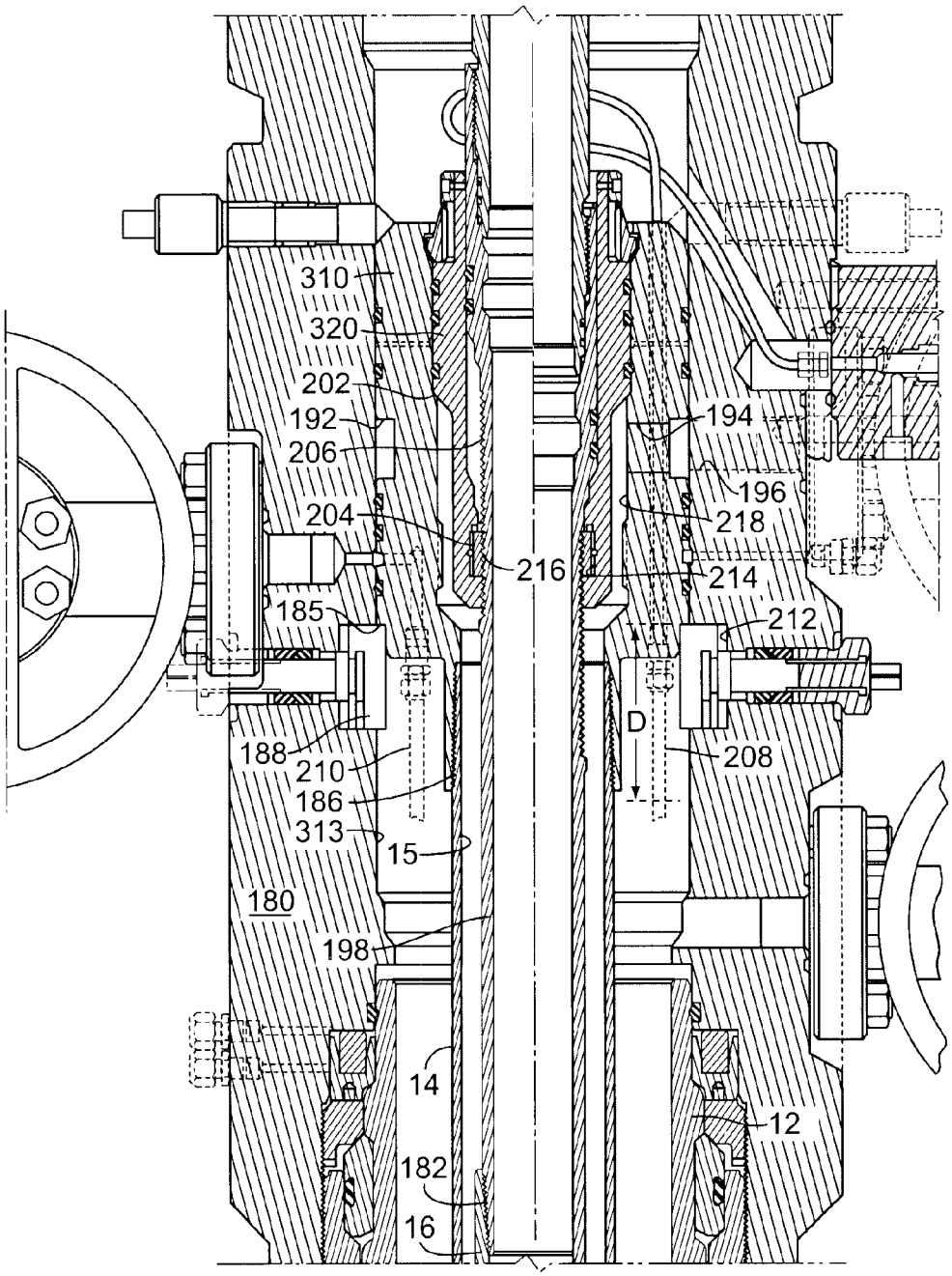

FIGS. 7*a* and 7*b* illustrate an alternative embodiment of the coiled tubing completion system of the present invention in which the tension in the outer tubing string 14 may be adjusted at the mudline wellhead 10 and the tension in the inner tubing string 16 may be adjusted at the surface christmas tree 180. Referring to FIG. 7*a*, the lower end of the outer tubing string 14 is threaded to the top of a mudline tubing hanger 30 generally at 163. The mudline tubing hanger 30 is locked to the central bore of a tieback connector 20 in a manner similar to that shown in FIG. 5. However, in this embodiment the locking ring 174, which corresponds to the locking ring 98 of FIG. 5, is provided with external teeth 176 which engage internal teeth 178 that are formed in the central bore of the tieback connector 20 when a piston 172, which is similar to the piston 94 of FIG. 5, is moved to its locked position. The teeth 178 extend for a substantial axial distance along the central bore of the tieback connector 20. That is, the teeth extend for an axial distance which is substantially greater than the axial height of the locking ring 174, thus providing a wide range of locking positions for the mudline tubing hanger 30. Therefore, the tension in the outer tubing string 14 can be adjusted by changing the axial position of the mudline tubing hanger 30 relative to the tieback connector 20.

Still referring to FIG. 7*a*, the inner tubing string 16 is threaded to an inner adapter 152 generally at 154. Once the mudline tubing hanger 30 is locked in position, the inner adapter 152 can be landed and locked to the mudline tubing hanger 30 with a ratch-latch mechanism 156 in a manner similar to that described in connection with the embodiment shown in FIG. 2*b*. A metal-to-metal seal 160 and a preferably elastomeric seal 158 are ideally provided to form a pressure tight seal between the inner adapter 152 and the inner diameter of the mudline tubing hanger 30.

Referring to FIG. 7*b*, the upper end of the outer tubing string 14 is threaded to the lower end of an outer tubing hanger 310 generally at 186. The outer tubing hanger 310 includes an external shoulder 185 which is landed on a number of retractable load shoulders 188 that are movably mounted in the central bore 313 of the surface christmas tree 180. The load shoulders 188 may be selectively retracted into corresponding recesses 212 that are formed in the central bore 313. The upper end of the inner tubing string 16 is threaded to the lower end of an inner adapter 198 generally at 182. The inner adapter 198 is connected to an inner tubing hanger 320 by a ratch-latch mechanism which will be described below. The inner tubing hanger 320 in turn is landed on a shoulder 202 which is formed in an axial bore 218 that extends through the outer tubing hanger 310.

The ratch-latch mechanism used to connect the inner adapter 198 to the inner tubing hanger 320 includes an inwardly biased lock ring 204 which is retained in a groove 214 that is formed on the inner diameter of the inner tubing hanger 320. The lock ring 204 includes a set of inwardly and upwardly facing teeth 216, and a substantial axially extending portion of the outer diameter of the inner adapter 198 is provided with a set of outwardly and downwardly facing teeth 206 which are adapted to engage the teeth 216 on the lock ring. The axial span of the teeth 206 is sufficient to provide a wide range of locking positions for the inner adapter 198. Thus, the tension in inner tubing string 16 can be adjusting by changing the position of the inner adapter 198 relative to the inner tubing hanger 320.

Referring still to FIG. 7*b*, the outer tubing hanger 310 comprises a circumferential groove 192 which is aligned with a gas injection port 196 in the surface christmas tree 180. A lateral port 194 in the outer tubing hanger 310 extends from the groove 192 to the axial bore 218 of the outer tubing hanger. The axial bore 218 is in fluid communication with the annulus 15 between the inner and outer tubing strings 16, 14. Thus a continuous fluid path is provided from the gas injection port 196 to the production tubing annulus 11 for providing high pressure gas for gas lift applications. Hydraulic lines 208 and 210 depend from the bottom of the outer tubing hanger 310 and are connected to hydraulic ports in the mudline tubing hanger for actuating the hanger locking mechanism previously described.

Referring to both FIGS. 7*a* and 7*b*, the mudline tubing hanger 30 is run down to the mudline wellhead 10 on the outer tubing string 14. As the mudline tubing hanger is run, the retractable load shoulders 188 are retracted into the grooves 212. When the mudline tubing hanger 30 reaches the tieback connector 20, the lower end of the upper tubing hanger 310 is lowered a previously calculated distance D below the retractable load shoulders 188. The mudline tubing hanger 30 is then locked to the tieback connector 20, and the weight of the mudline tubing hanger 30 and the production tubing string 18 are transferred to the tieback connector 20 and, ultimately, to the mudline wellhead 10. Since the outer tubing string 14 is no longer carrying these loads, the tension in the outer tubing string drops until it is below a desired final tension. Since the weight of all the components is known, the tension in the outer tubing string 14 after landing the mudline tubing hanger 30 can be calculated beforehand. The difference between this tension and the desired final tension may then be used to calculate the distance the outer tubing string 14 must be stretched to bring the tension up to the desired level. This stretch distance is the distance D which is shown in FIG. 7*b*. The outer tubing hanger 310 is raised this distance D to set the proper desired final tension in the outer tubing string 14. At this point the external shoulder 185 of the outer tubing hanger 310 is just above the retractable load shoulders 188, and the retractable load shoulders 188 may be extended and the outer tubing hanger 310 released and landed on the load shoulders.

Figure 8A:
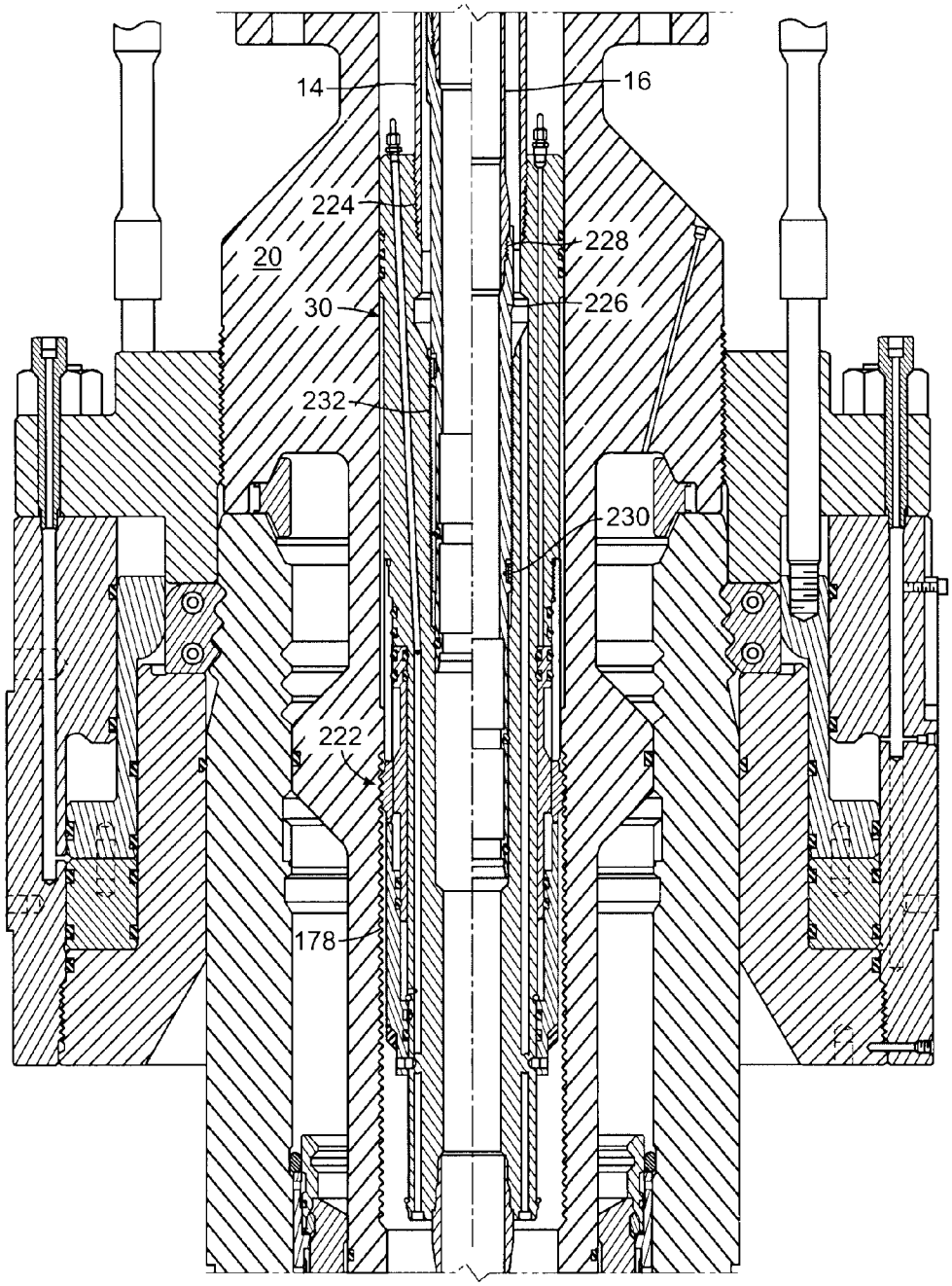
FIGS. 8*a* and 8*b* are cross-sectional views showing the components of yet another alternative embodiment of the invention connected to the mudline wellhead component and to the surface christmas tree component, respectively.
Figure 8B:
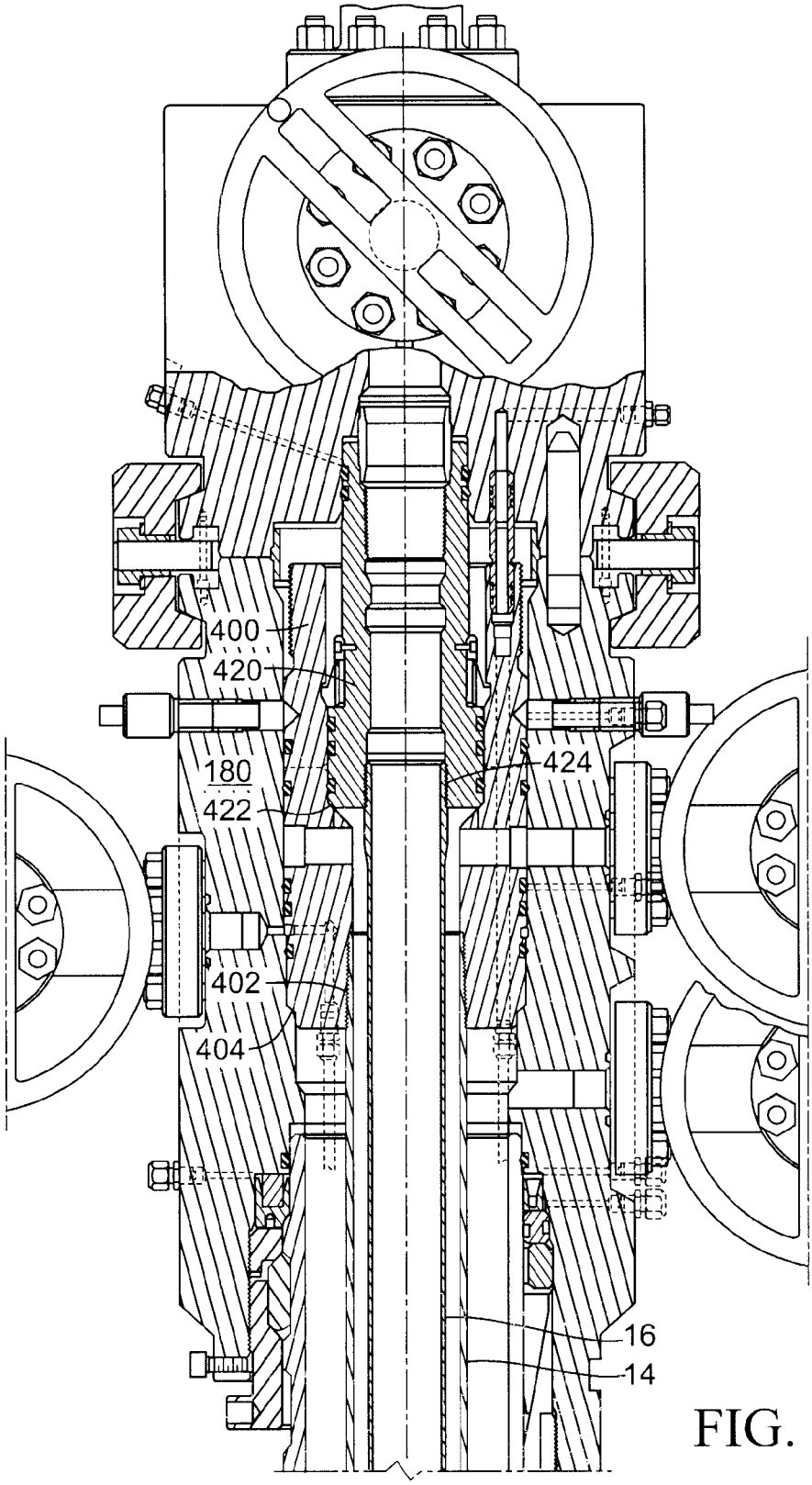

FIGS. 8*a* and 8*b* illustrate an alternative embodiment of the concentric tubing completion system in which the tension in both the inner and outer tubing strings 16, 14 may be adjusted at the mudline wellhead 10. Referring to FIG. 8*a*, the lower end of the outer tubing string 14 is threaded to the upper end of the mudline tubing hanger 30 generally at 224. The mudline tubing hanger 30 is locked to the tieback connector 20 generally at 222 in a manner similar to that shown in FIG. 7*a*. The long extent of internal teeth 178 provides a wide range of locking positions for the mudline tubing hanger 30. Thus, the tension in the outer tubing string 14 can be adjusting by changing the position of the mudline tubing hanger 30 relative to the tieback connector 20.

Referring still to FIG. 8*a*, the lower end of the inner tubing string 16 is threaded to the upper end of an inner adapter 226 generally at 228. The inner adapter 226 is locked to the mudline tubing hanger 30 in a manner similar to that shown in FIG. 6*a*. The long extent of internal teeth 232 provides a wide range of locking positions for the inner adapter 226. Thus, the tension in the inner tubing string 16 can be adjusted by changing the position of the inner adapter 226 relative to the mudline tubing hanger 30.

Referring to FIG. 8*b*, since the tension in both the inner and outer tubing strings 16, 14 is adjusted at the mudline wellhead 10, both strings can be landed solidly at the surface christmas tree 180. The upper end of the outer tubing string 14 is threaded to an outer tubing hanger 400 generally at 402. The outer tubing hanger 400 is landed on an internal shoulder 404 in the central bore of the surface christmas tree 180. In addition, the upper end of inner tubing string 16 is threaded to an inner tubing hanger 420 generally at 424. Finally, the inner tubing hanger 420 is landed on an internal shoulder 422 in outer hanger 400.

It should be understood that, although a tieback connector 20 is preferred for simplifying the connection of the mudline tubing hanger 30 to the mudline wellhead 10, the tieback connector may be eliminated and the mudline tubing hanger instead landed directly in the mudline wellhead. In this circumstance, a landing shoulder for the mudline tubing hanger 30 would be formed on the bore of the mudline wellhead 10. In addition, the grooves such as groove 42 and the teeth such as teeth 178 that are formed in the central bore of the tieback connector 20 to facilitate the connection of the mudline tubing hanger to the tieback connector would instead be formed on the bore of the mudline wellhead 10. Finally, if a riser pipe is employed with this system, it would be connected to the top of the mudline wellhead 10, such as with the locking assembly 22, instead of the tieback connector 20.

In addition, it should be understood that the inner and outer adapters which are used to connect the inner and outer tubing strings 16, 14 to the mudline tubing hanger 30, for example adapters 116 and 112, respectively, are provided primarily to simplify the manufacture of the inner and outer tubing strings and the assembly of the concentric tubing completion system. Consequently, these adapters could be eliminated from the present invention and instead the inner and outer tubing strings could be appropriately modified for connection directly to the mudline tubing hanger. Therefore, statements in the appended claims concerning the connection of the inner and outer tubing strings, or the lower portions thereof, to the mudline tubing hanger should be construed to include either of the above scenarios, where appropriate.

Similarly, the expander bushing 356 and the inner and outer adapters, such as adapters 330 and 262, respectively, which are used to connect the inner and outer tubing strings 16, 14 to their respective inner and outer tubing hangers are also provided primarily to simplify the manufacture of the inner and outer tubing strings and the assembly of the concentric tubing completion system. Thus, the expander bushing and these adapters could be eliminated from the present invention and instead the inner and outer tubing strings could be appropriately modified for connection to their respective inner and outer tubing hangers without such components. Therefore, statements in the appended claims concerning the connection of the inner and outer tubing strings, or the upper portions thereof, to the inner and outer tubing hangers should be construed to include either of the above scenarios, where appropriate.

It should be recognized that, while the present invention has been described in relation to the preferred embodiments thereof, those skilled in the art may develop a wide variation of structural and operational details without departing from the principles of the invention. For example, the various elements illustrated in the different embodiments may be combined in a manner not illustrated above. Therefore, the appended claims are to be construed to cover all equivalents failing within the true scope and spirit of the invention.

We claim:

1. A concentric tubing completion system for communicating a fluid between a surface structure and a mudline wellhead which is installed at the upper end of a subsea well bore, the completion system comprising:

a surface christmas tree which is located on the surface structure;

a tieback connector which is connected to the mudline wellhead;

a mudline tubing hanger which is supported in the tieback connector and from which is suspended a tubing string that extends into the well bore and defines a tubing annulus surrounding the tubing string;

an outer tubing hanger which is supported by the surface christmas tree;

an inner tubing hanger which is supported by the surface christmas tree;

an outer tubing string which is connected between the outer tubing hanger and the mudline tubing hanger; and an inner tubing string which is disposed within the outer tubing string and which is connected between the inner tubing hanger and the mudline tubing hanger;

wherein the inner and outer tubing strings define an annulus between them which communicates with a number of annulus passageways that extend through the mudline tubing hanger to the tubing annulus;

whereby the fluid may be communicated between the surface christmas tree and the tubing annulus through the annulus between the inner and outer tubing strings.

2. The completion system of claim 1, further comprising a riser pipe which is connected between the surface christmas tree and the tieback connector and which surrounds the outer tubing string.

3. The completion system of claim 1, further comprising means for locking the mudline tubing hanger to the tieback connector.

4. The completion system of claim 3, wherein the locking means comprises:

a locking ring which is supported on an outer portion of the mudline tubing hanger;

a locking groove which is formed on a central bore of the tieback connector within which the outer portion of the mudline tubing hanger is received; and means for selectively moving the locking ring into the locking groove to thereby secure the mudline tubing hanger relative to the tieback connector.

5. The completion system of claim 4, further comprising means for returning the moving means to a position in which the locking ring is out of the locking groove.

6. The completion system of claim 3, wherein the locking means comprises:

a locking ring which is supported on an outer portion of the mudline tubing hanger and which includes at least one first tooth formed on an outer diameter thereof;

a plurality of second teeth which are formed on a central bore of the tieback connector within which the outer portion of the mudline tubing hanger is received; and means for moving the locking ring against the second teeth to thereby secure the mudline tubing hanger relative to the tieback connector.

7. The completion system of claim 6, wherein the locking ring comprises an axial length and the second teeth extend axially along the central bore a distance which is substantially greater than the axial length of the locking ring.

8. The completion system of claim 1, further comprising means for connecting the inner tubing string to the mudline tubing hanger.

9. The completion system of claim 8, wherein the connecting means comprises:

a latch ring which is supported on a lower portion of the inner tubing string and which includes at least one first tooth formed on an outer diameter thereof;

a plurality of second teeth which are formed on a bore of the mudline tubing hanger within which the lower portion of the inner tubing string is received; and means for urging the first tooth into engagement with the second teeth.

10. The completion system of claim 9, wherein the latch ring comprises an axial length and the plurality of second teeth extend axially along the bore a distance which is substantially greater than the axial length of the latch ring.

11. The completion system of claim 9, further comprising means for sealing between the bore and the lower portion of the inner tubing string.

12. The completion system of claim 1, further comprising means for securing the inner tubing string to the inner tubing hanger.

13. The completion system of claim 12, wherein the securing means comprises:

a lock ring which is supported on an inner diameter portion of the inner tubing hanger and which includes at least one first tooth formed on an inner diameter thereof;

a plurality of second teeth which are formed on an upper portion of the inner tubing string which is received within the inner diameter portion of the inner tubing hanger; and means for urging the first tooth into engagement with the second teeth.

14. The completion system of claim 13, wherein the lock ring comprises an axial length and the plurality of second teeth extend axially along the upper portion of the inner tubing string a distance which is substantially greater than the axial length of the lock ring.

15. The completion system of claim 1, further comprising means for attaching the outer tubing string to the outer tubing hanger.

16. The completion system of claim 15, wherein the attaching means comprises:

a tubular sleeve which is connected to the outer tubing hanger and which surrounds an upper portion of the outer tubing string;

a lock ring which is supported on the sleeve and which includes at least one first tooth formed on an inner diameter thereof;

a plurality of second teeth which are formed on the upper portion of the outer tubing; and means for urging the first tooth into engagement with the second teeth.

17. The completion system of claim 16, wherein the urging means comprises:

a tubular mandrel which is positioned between the sleeve and the upper portion of the outer tubing string and which includes a plurality of fingers depending axially therefrom; and means for moving the mandrel downward to bring the fingers behind the lock ring and thereby urge the lock ring against the upper portion of the outer tubing string.

18. A concentric tubing completion system for communicating a fluid between a surface structure and a mudline wellhead which is installed at the upper end of a subsea well bore, the completion system comprising:

a surface christmas tree which is located on the surface structure;

a mudline tubing hanger which is supported by the mudline wellhead and from which is suspended a tubing string that extends into the well bore and defines a tubing annulus surrounding the tubing string;

an outer tubing hanger which is supported by the surface christmas tree;

an inner tubing hanger which is supported by the surface christmas tree;

an outer tubing string which is connected between the outer tubing hanger and the mudline tubing hanger; and an inner tubing string which is disposed within the outer tubing string and which is connected between the inner tubing hanger and the mudline tubing hanger;

wherein the inner and outer tubing strings define an annulus between them which communicates with a number of annulus passageways that extend through the mudline tubing hanger to the tubing annulus;

whereby the fluid may be communicated between the surface christmas tree and the tubing annulus through the annulus between the inner and outer tubing strings.

19. The completion system of claim 18, further comprising:

a tieback connector which is connected to the mudline wellhead;

wherein the mudline tubing hanger is supported in the tieback connector.

20. A concentric tubing completion system for communicating a gas from a surface christmas tree which is located on a surface structure to a mudline wellhead which is installed at the upper end of a subsea well bore, the completion system comprising:

a tieback connector which is connected to the mudline wellhead;

a mudline tubing hanger which is supported in the tieback connector and from which is suspended a tubing string that extends into the well bore and defines a tubing annulus surrounding the tubing string;

an outer tubing hanger which is supported in the surface christmas tree;

an inner tubing hanger which is supported in the outer tubing hanger;

a riser pipe which is connected between the surface christmas tree and the tieback connector;

an outer tubing string which is disposed within the riser pipe and is connected between the outer tubing hanger and the mudline tubing hanger; and an inner tubing string which is disposed within the outer tubing string and is connected between the inner tubing hanger and the mudline tubing hanger;

wherein the inner and outer tubing strings define an annulus between them which communicates with a gas injection port in the surface christmas tree and a number of annulus passageways that extend through the mudline tubing hanger to the tubing annulus;

whereby the gas may be communicated from the surface christmas tree to the tubing annulus through the annulus between the inner and outer tubing strings.

* * * * *